10/15/85 OR 4,547,306

United States Patent [19]

Hase et al.

[11] Patent Number: 4,547,306

[45] Date of Patent: Oct. 15, 1985

[54] FABRIC DETERGENT COMPOSITIONS CONTAINING ACYLCYANAMIDES

[75] Inventors: Christian Hase, Erkrath; Martin Bischoff, Gelsenkirchen; Edmund Schmadel, Leichlingen; Günther Vogt, Toenisvorst, all of Fed. Rep. of Germany

[73] Assignee: Henkel KGaA, Duesseldorf, Fed. Rep. of Germany

[21] Appl. No.: 618,608

[22] Filed: Jun. 8, 1984

[30] Foreign Application Priority Data

Jun. 9, 1983 [DE] Fed. Rep. of Germany ..... 3320726

[51] Int. Cl.[4] ..... C11D 3/32; C11D 7/18

[52] U.S. Cl. ..... 252/99; 252/102; 252/110; 252/117; 252/141; 252/525; 252/544; 252/DIG. 2; 252/174.25

[58] Field of Search ..... 252/117, 110, 141, 525, 252/544, DIG. 2, DIG. 14, 99, 102, 174.25; 260/404.5 CN; 564/106

[56] References Cited

U.S. PATENT DOCUMENTS

| | | | |
|---|---|---|---|
| 3,966,789 | 6/1976 | Oishi et al. | 260/404.5 CN |
| 4,392,975 | 7/1983 | Touroot | 252/99 |

FOREIGN PATENT DOCUMENTS

| | | |
|---|---|---|
| 84836 | 8/1983 | European Pat. Off. . |
| 708428 | 7/1941 | Fed. Rep. of Germany . |
| 2733790 | 2/1979 | Fed. Rep. of Germany . |
| 3031636 | 4/1982 | Fed. Rep. of Germany . |
| 3202213 | 8/1983 | Fed. Rep. of Germany . |
| 428091 | 5/1935 | United Kingdom . |

OTHER PUBLICATIONS

A. E. Kretov, A. P. Momsenko in J. of Org. Chem. of USSR 1, (1965), p. 1765.

*Primary Examiner*—Prince E. Willis

*Attorney, Agent, or Firm*—Ernest G. Szoke; Henry E. Millson, Jr.; Mark A. Greenfield

[57] ABSTRACT

A detergent composition for fabrics containing at least one synthetic surfactant from the group comprising anionic and nonionic surfactants and at least one builder from the group comprising condensed phosphates and phosphate substitutes, wherein at least one acylcyanamide salt anionic surfactant is present.

19 Claims, No Drawings

FABRIC DETERGENT COMPOSITIONS CONTAINING ACYLCYANAMIDES

BACKGROUND OF THE INVENTION

1. Field of the Invention

This invention relates to detergent compositions containing acylcyanamide salts, useful for cleaning solid materials, particularly fabrics.

2. Statement of the Prior Art

The development of modern fabric detergents, which began in the thirties, had resulted by 1960 in an almost complete departure from the hitherto widely used detergents based on soap, soda and silicate. In their place came products which contained (a) synthetic anionic and nonionic surfactants, (b) builders, particularly pentasodium triphosphate, and (c) redeposition inhibitors, generally carboxymethyl cellulose, which improved soil suspending power. Soap was only added to a minimal extent as a foam regulator. Without any deterioration in the primary washing effect, these modern detergents produced a significant improvement in the secondary washing effect by comparison with older detergents, as reflected in particular in a reduction in the level of incrustation on the fabrics.

Despite the high quality of fabric treatment achieved with these detergents, attempts were made and are still being made to obtain further improvements in the quality of detergents and to adapt them to changing circumstances. Similar efforts are being made throughout the entire field of detergents and cleaners. Examples of improvements of the type in question are the change from substantially nonbiodegradable to rapidly degradable surfactants and the replacement of the soluble builder phosphates by insoluble sodium aluminium silicates of the zeolite A type.

DESCRIPTION OF THE INVENTION

The present invention makes it possible, by changing the surfactant base, to use renewable raw materials and those from indigenous sources to a greater extent than before. The present invention also facilitates production of the detergents and, at the same time, improves their performance properties, particularly the cleaning power and soil suspending power of the wash liquor and, where the detergents are used for fabrics, reduces incrustation and improves the feel of the washed fabrics.

To achieve the above, the present invention affords detergent compositions containing at least one acylcyanamide salt corresponding to the general formula:

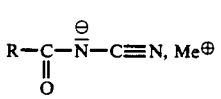

(I)

in which Me represents sodium or potassium and R is an alkyl or alkenyl radical containing from about 9 to 23 carbon atoms, which may be substituted by hydroxyl or alkoxyl groups, as an anionic surfactant. That such compositions are effective detergents is all the more surprising insofar as, from the point of view of chemical structure and physicochemical properties, the above formula surfactants bear a very much stronger resemblance to soaps than to the synthetic anionic surfactants of the sulfonate or sulfate type which have been used almost exclusively for more than 20 years. Accordingly, the suitability of the acylcyanamides for use in modern detergent compositions was unexpected.

More particularly, the present invention affords a detergent composition for solid materials, especially fabrics, which contains at least one synthetic surfactant from the group comprising anionic and nonionic surfactants and at least one builder from the group comprising condensed phosphates and phosphate substitutes and in which the anionic surfactant component consists completely or partly of an acylcyanamide salt corresponding to the above Formula I.

Acylcyanamide salts as compounds are not new. The first homologs were described in 1878 by O. Mertens (J. prakt. Chemie (2) 17, 4). The soap-like properties of the higher homologs which made them suitable for wetting agents and dispersants was also mentioned as long ago as 1935 in British Pat. No. 428,091.

By contrast, there are no known publications from which the unusually good effects of these compounds in modern detergents could be inferred. Although European patent application No. 24,676 (and corresponding U.S. Pat. No. 4,394,129), which relates to a process for refining textiles, does include the acylcyanamide salts of Formula I in a very broad formula, it does not make any reference whatever to the surfactant properties of these compounds or to detergents. In the process described in the above-mentioned European patent application, the acylcyanamide group is used as a reactive group for fixing active substances to fibrous materials.

European patent application No. 8,475 (and corresponding U.S. Pat. No. 4,199,466), which describes a bleaching process and bleaching agents containing cyanamines as activators, also covers the acylcyanamide salts according to the present invention in a broad formula. In this European patent application, cyanamines are used for the purpose of activating peroxide bleaches in order to increase their oxidizing power. There is no mention whatever of surfactant properties.

The acylcyanamide salts according to the invention may be obtained from carboxylic acid derivatives and cyanamide, followed by neutralization with suitable bases (cf. German Patent No. 708,428 or A. E. Kretov and A. P. Momsenko, J. Org. Chem. (USSR) 1, 1765 (1965)).

A more simple method is to react salts of cyanamide with carboxylic acid esters, as described in German patent application No. P 32 02 213 published Aug. 4, 1983 and commonly assigned. This process may also be of advantage for the further use of the acylcyanamide salts in the production of detergents because it gives the salts in anhydrous form.

In addition to ease of production, the acylcyanamide salts have the advantage that they can be produced from renewable raw materials, in this case fatty acid derivatives, and the cyanamide is readily obtainable from nitrolime (calcium cyanamide). Accordingly, where these surfactants are used, the detergent manufacturer is not so dependent upon petroleum-based raw materials such as, for example, alkylbenzene sulfonate which is still the most important anionic surfactant. In addition, acylcyanamide salts show good biodegradability and are toxicologically acceptable.

Particularly favorable properties for the purposes of the present invention are shown by the sodium salts of the acylcyanamides, particularly those in which the radical R in Formula I represents a substantially unsubstituted alkyl or alkenyl radical containing from about 11 to 17 carbon atoms. Salts such as these may readily be obtained on a commercial scale from monosodium cyanamide and the methyl esters of natural fatty acid mixtures, such as tallow fatty acid methyl ester and palm kernel oil fatty acid methyl ester.

The detergents according to the invention may be used for a variety of cleaning functions in many areas of industry and in the home. Examples of applications such as these include the cleaning of appliances, apparatus, pipes and vessels of wood, plastic, metal, ceramic, glass, etc., in factories and offices, the cleaning of furniture, walls, floors, articles of ceramics, glass, metals, wood, plastics, the cleaning of polished or painted surfaces in the home, etc. One particularly important application is the washing of fabrics of all kinds in industry, in commercial laundries and in the home.

Synthetic anionic surfactants which may be present in the detergents according to the invention in addition to the acylcyanamide salts are, in particular, those of the sulfonate and sulfate type.

The sulfonate-type surfactants are, primarily, alkylbenzene sulfonates containing $C_{9-15}$-alkyl groups and the esters of $\alpha$-sulfofatty acids, for example the $\alpha$-sulfonated methyl or ethyl esters of hydrogenated coconut oil, palm kernel oil or tallow fatty acids. Other suitable surfactants of the sulfonate type are the alkane sulfonates obtainable from $C_{12-18}$-alkanes by sulfochlorination or sulfoxidation, followed by hydrolysis or neutralization, or by the addition of bisulfites onto olefins and also olefin sulfonates, i.e. mixtures of alkene and hydroxyalkane sulfonates and disulfonates of the type obtained from monoolefins containing an internal or terminal double bond by sulfonation with gaseous sulfur trioxide, followed by alkaline or acidic hydrolysis of the sulfonation products.

Particularly suitable surfactants of the sulfate type are the sulfuric acid monoesters of primary alcohols of natural and synthetic origin, i.e. fatty alcohols, such as coconut oil fatty alcohols, tallow fatty alcohols, oleyl alcohol, or $C_{10-20}$-oxoalcohols, and monoesters of secondary alcohols having chain lengths in that range. Other suitable sulfate surfactants are the sulfuric acid monoesters of aliphatic primary alcohols ethoxylated with from 1 to 6 mols of ethylene oxide and ethoxylated secondary alcohols or alkyl phenols. Sulfated fatty acid alkanolamides and sulfated fatty acid monoglycerides are also suitable.

All these anionic surfactants are preferably used in the form of their salts, particularly their sodium salts, but also potassium or ammonium salts, or in the form of soluble salts of organic bases, such as mono-, di- or triethanolamine.

Particularly favorable performance properties are exhibited by detergents according to the invention which contain from about 1 to 30% by weight and preferably from about 3 to 15% by weight of acylcyanamide salt and from about 1 to 30% by weight and preferably from about 3 to 15% by weight of a synthetic anionic surfactant selected from the group comprising alkylbenzene sulfonates, ester sulfonates, alcohol sulfates and mixtures thereof, in addition to other standard detergent ingredients. All parts by weight are based upon the total weight of the detergent composition unless otherwise indicated.

Suitable nonionic surfactants for the detergents of this invention are adducts of from about 1 to 40 mols and preferably from about 2 to 20 moles of ethylene oxide with 1 mol of an aliphatic compound essentially containing from 10 to 20 carbon atoms and selected from the group comprising alcohols, alkyl phenols, carboxylic acids and carboxylic acid amides. Particular importance is attributed to the adducts of from about 8 to 20 mols of ethylene oxide with primary alcohols, suh as coconut oil or tallow fatty alcohols, with oleyl alcohol, with oxo alcohols having corresponding chain lengths or with corresponding secondary alcohols and also with mono- or dialkylphenols containing from about 6 to 14 carbon atoms in the alkyl radicals. In addition to these water-soluble nonionics, however, water-insoluble or substantially water-insoluble polyglycol ethers containing from 2 to 7 ethylene glycol ether residues in the molecule are also of interest, particularly when they are used in conjunction with water-soluble nonionic or anionic surfactants. By virtue of their favorable biodegradability, particular practical interest is attributed above all to the ethoxylation products of primary aliphatic alkanols and alkenols.

Typical representatives of the nonionic surfactants having an average degree of ethoxylation of from 2 to 7 which are suitable for use in accordance with the invention are coconut oil fatty alcohol-3 E.O. (E.O.=ethylene oxide), tallow fatty alcohol-5 E.O., oleyl/cetyl alcohol-5 E.O. (iodine number 30–50), tallow fatty alcohol-7 E.O., synthetic-$C_{12-16}$-fatty alcohol-6 E.O., $C_{11-15}$-oxoalcohol-3 E.O., $C_{14-15}$-oxoalcohol-7 E.O., i-$C_{15-17}$-alkane diol-5 E.O. (i=internal); and sec.-$C_{11-15}$-alcohol-4 E.O.

Examples of the nonionic surfactants having an average degree of ethoxylation of from 8 to 20, more particularly from 9 to 15, are coconut oil fatty alcohol-12 E.O., synthetic-$C_{12-14}$-fatty alcohol-9 E.O., oleyl/cetyl alcohol-10 E.O., tallow fatty alcohol-14 E.O., $C_{11-15}$-oxoalcohol-13 E.O., $C_{15-18}$-oxoalcohol-15 E.O., i-$C_{15-17}$-alkane diol-9 E.O., $C_{14-15}$-oxoalcohol-11 E.O., and sec.-$C_{11-15}$-alcohol-9 E.O.

Other suitable nonionic surfactants are the water-soluble adducts—(containing from about 20 to 250 ethylene glycol ether groups and from about 10 to 100 propylene glycol ether groups)—of ethylene oxide with polypropylene glycol, with alkylene diaminepolypropylene glycol, and with alkyl polypropylene glycols containing from 1 to 10 carbon atoms in the alkyl chain, in which the polypropylene glycol chain functions as a hydrophobic residue.

Other suitable nonionic surfactants are those of the amine oxide or sulfoxide type, for example N-cocoalkyl-N,N-dimethylamine oxide, N-hexadecyl-N,N-bis-(2,3-dihydroxypropyl)-amine oxide, and N-tallow alkyl-N,N-dihydroxyethylamine oxide.

Where acylcyanamide salts are used in conjunction with nonionic surfactants, an unusually good detergent effect is obtained with detergents containing from about 1 to 30%, preferably from about 3 to 15%, by weight of acylcyanamide salt and from about 1 to 30%, preferably from about 2 to 15%, by weight of nonionic surfactant selected from the group comprising alcohol ethoxylates and alkylphenol ethoxylates in addition to other standard detergent ingredients.

Particularly high detergent power with respect to fat- and pigment-containing soil is shown by detergents containing the acylcyanamide salts in combination with nonionic surfactants of the alcohol ethoxylate type.

This surfactant combination contains acylcyanamide salts and nonionic surfactants corresponding to the following formula $$R—O—(CH_2—CH_2—O)_m—H \quad (II)$$

in which R represents an n-alkyl or n-alkenyl radical containing from about 12 to 18 carbon atoms and m has an average value of from about 4 to 15. The nonionic surfactants are combined with the acylcyanamide salts in a ratio by weight of from about 1:4 to 4:1 and preferably in a ratio of from about 2:3 to 4:1 and are present in the detergents in a quantity of from about 2 to 50% preferably from about 5 to 30% by weight.

This particular high detergent power with respect to fat and pigment containing soil is especially important because soil of this type is the most commonly encountered soil on washable fabrics and, even with currently available detergents, cannot always be removed adequately.

Detergents according to the invention containing both synthetic anionic and nonionic surfactants in addition to the acylcyanamide salt show a very wide range of activity, i.e. they satisfactorily remove many different types of soil. In addition to other standard ingredients, detergents such as these contain from about 1 to 30% (preferably from about 3 to 15%) by weight of acylcyanamide corresponding to Formula I, from 0 to about 30% (preferably about 1 to 30%, most preferably from about 3 to 15%) by weight of another (synthetic) anionic surfactant, particularly one selected from the group comprising alkylbenzene sulfonates, ester sulfonates, alcohol sulfates and mixtures thereof, and from 0 to about 30% (preferably about 1 to 30%, most preferably from about 2 to 15%) by weight of a nonionic surfactant, particularly one selected from the group comprising alcohol ethoxylates, alkylphenol ethoxylates and mixtures thereof.

In addition to the surfactants, the detergents according to the invention as modern detergents contain builders whose function is to enhance the detergent effect of the surfactants and to eliminate any adverse effects caused by water hardness.

Among the builders, condensed phosphates, particularly pentasodium triphosphate, have previously been prominent. These phosphates show excellent performance properties and may be present in the detergents as the sole builder component. However, they may also be completely or partly replaced in the detergents by phosphate substitutes, above all when this reduces or avoids waste water pollution by the phosphates resulting in the eutrophication of standing waters.

Suitable phosphate substitutes are inorganic and organic compounds which have a builder effect at least partly equivalent to that of sodium tripolyphosphate. Particularly suitable water-soluble inorganic compounds are alkali carbonates and alkali silicates. Suitable water-soluble organic compounds are selected hydroxycarboxylic acids, aminocarboxylic acids, polycarboxylic acids, carboxyalkyl ethers, polymeric polycarboxylic acids and substituted and unsubstituted alkane di- and polyphosphonic acids. Typical examples of compounds belonging to these groups are citric acid, nitrilotriacetic acid, mellitic acid, carboxymethyloxysuccinic-acid, polyacrylic acid, polymethacrylic acid, poly-α-hydroxyacrylic acid, polymaleic acid and the corresponding copolymers and hydroxyethane diphosphonic acid. These compounds are generally used in the form of their water-soluble salts.

In recent years, particular practical significance has been acquired by the finely particulate, cation-exchanging, crystalline sodium aluminosilicates which were described for the first time as phosphate substitutes for detergents in German patent application No. 24 12 837. These compounds are also useful in this invention and have the following composition: $0.7–1.1Na_2O\ Al_2O_3\ 1.3–3.3SiO_2xH_2O$, with a calcium binding power of from 100 to 200 mg of CaO/g (based on the anhydrous substance). These finely particulate, hydrated sodium alumosilicates include, in particular, the zeolites NaA and NaX. On a large scale, the zeolite NaA above all is used as a substitute for sodium tripolyphosphate in low-phosphate and phosphate-free detergents.

The builder component is generally present in the detergent according to the invention in a quantity of the balance to 100% total weight of the composition, to which total weight may be added auxiliary, nondetergent ingredients. A numerical designation would be from about 3 to 70% (preferably about 20 to 50%) by weight. Individual builders, for example alkane polyphosphonates, may even be present in much smaller quantities, i.e. in quantities of from about 0.1 to 3% by weight.

In addition to their already mentioned high detergent power, the detergents according to the invention in practice show a surprisingly high soil suspending power as another special property. In the washing of fabrics for example, it is possible with the detergents according to the invention to achieve low redeposition values of a level which would otherwise only be achieved in the presence of special redeposition inhibitors, i.e. in general high molecular weight polyionic compounds. The effect of this is that there is no need whatever to use redeposition inhibitors, which considerably simplifies the detergent formulation. However, the detergents may readily contain redeposition inhibitors, in which case they develop a higher soil suspending power in the wash liquor than conventional detergents.

Suitable redeposition inhibitors are water soluble, mostly organic colloids such as, for example, the water soluble salts of polymeric carboxylic acids, glue, gelatin, salts of ether carboxylic acids or ether sulfonic acids of starch or cellulose or salts of acidic sulfuric acid esters of cellulose or starch. Water-soluble polyamides containing acid groups are also suitable for this purpose. Preferred redeposition inhibitors are carboxymethylated cellulose or starch in the form of their sodium salts, methyl celluloses and also polymers and copolymers of methacrylic acid, acrylic acid and maleic acid. It is also possible to use soluble starch preparations and other starch products than those mentioned above, such as for example degraded starch, aldehyde starches, etc. Dye transfer inhibitors of the polyvinyl pyrrolidone type may also be used.

Another surprising property of the detergents according to the invention is that they leave washed cotton fabrics with a much softer feel than standard modern detergents. This feel may be so soft as to eliminate the need to incorporate special softeners in the detergents, as is occasionally done today, and even the need to carry out subsequent softening at the rinsing stage. This effect is particularly noticeable in the case of detergents containing more than about 6% by weight and, in particular, more than about 12% by weight of the acylcyanamides.

To remove certain vegetable stains, bleaches may be present in the detergents according to this invention. Particularly suitable bleaches are known bleaches of the peroxide type ("per" compounds) such as sodium perborate, sodium carbonate perhydrate, potassium peroxomonosulfate and organic percarboxylic acids. These bleaches may be used either individually or in combination with known stabilizers, such as magnesium silicate, sodium methylene diamine tetraacetate or sodium salts of polyphosphonic acids, whose function is to prevent the premature decomposition of the per compounds by heavy metal salts with resulting damage to the fabrics.

In addition, bleach activators may be used together with the bleaches. Of the many activators proposed in the literature, particularly suitable types are anhydrides, carboxylic acid amides and carboxylic acid esters which have an acylating effect on $H_2O_2$ in the wash liquor and, in this way, intensify the bleaching power of the liquor. Examples of suitable activators are phthalic acid anhydride, tetraacetyl ethylene diamine, tetraacetyl glycol uril and pentaacetyl glucose.

The quantity of optional activators in the detergents amounts to no more than about 1 equivalent (preferably between 0.1 and 1 equivalent), based on the quantity of per compound present. The per compounds themselves may be present in 0 to about 40% (preferably from about 1 to 30%) by weight and the optional stabilizers in quantities of from about 0.01 to 5% by weight.

In addition to the ingredients already mentioned, the detergents according to the invention may contain auxiliary ingredients such as enzymes, perfume oils, electrolytes, microbicides and optical brighteners. The auxiliary ingredients are in addition to 100% of the detergent composition.

Suitable foam inhibiting additives are soaps containing from 20 to 24 carbon atoms, long chain alkyl melamines, low foam nonionic surfactants, paraffin hydrocarbons, microcrystalline waxes and silicone foam inhibitors. Particular importance is attributed to foam suppressing soaps and silicone compounds, i.e. polysiloxanes activated by finely particulate $SiO_2$. An addition of 0 to about 20% by weight is always sufficient for effective foam regulation, an addition of about from 0.1 to 10% by weight being preferred.

Any enzymes capable of intensifying the detergent effect, such as proteases, lipases and amylases, may be present as enzymes in the detergents according to the invention. It is preferred to use enzymes which develop an optimum effect at a pH-value in the range reached in the practical application of the detergents, and enzymes of the type which retain their effect, even at elevated temperatures.

Electrolytes may be present in the detergents to increase ionic strength in the solutions used, for pH-regulation, as supports or masking agents, for desensitizing per compounds, or even simply as fillers. Preferred electrolytes are salts of sodium and potassium, for example sodium borate, sodium sulfate and potassium hydrogen phosphate, although weak acids such as boric acid, or bases such as ammonia, may also be used.

Microbicides may be ingredients of detergent formulations which are additionally intended to develop a disinfecting effect in their practical application. Suitable microbicides are any of the usual bactericides and fungicides providing they are compatible with the other ingredients of the detergents.

Optical brighteners are used in the detergents according to the invention when the detergents are also intended to increase the apparent whiteness of the treated articles. Numerous compounds have been described in the literature as suitable for this purpose. Particularly suitable optical brighteners for fabric detergents are derivatives of diaminostilbene disulfonic acid and salts thereof, for example 4,4'-bis-(2-anilino-4-morpholino-1,3,5-triazin-6-ylamino)-stilbene-2,2'-disulfonic acid, and brighteners of the substituted 4,4'-distyrylbiphenyl type, for example 4,4'-bis-(4-chloro-3-sulfostyryl)-biphenyl.

The detergents according to the invention may be produced by any of the processes normally used for manufacturing conventional detergents. In the most simple case, solid detergents may be produced simply by mixing the powder form or granular individual ingredients. Products which show better flow properties and which, in addition, contain less dust are obtained by granulation or by spray drying. In every case, production of the detergents is considerably simplified by using the acylcyanamide salts in their anhydrous form in which they may readily be produced on a commercial scale. In addition, the favorable temperature stability of the acylcyanamide salts also has a positive effect in the spray drying process. Paste-form and liquid detergents may also be produced by conventional processes. In general, the starting materials are both predissolved and also solid ingredients which may optionally be mixed with more solvent, generally water, and homogenized. It is possible by applying heat and mechanical energy to accelerate the homogenization process, which is in any case facilitated to a considerable extent by the high solubility of the acylcyanamide salts. To dissolve other organic ingredients, it may be advisable to add water-miscible organic solvents, such as ethanol or isopropanol, while the addition of hydrotropes, such as NaCl or triethanolamine, may be advisable for adjusting certain viscosities.

EXAMPLES

The following examples describe compositions of several detergents according to the invention. For reasons of space, some ingredients which are not essential to the invention, such as perfumes, enzymes, stabilizers, $Na_2SO_4$ and water, have not been listed. Unless otherwise indicated, ionic ingredients, such as anionic surfactants and salts, are present in the form of sodium salts. The acronyms and abbreviations used in the Table have the following meanings:

AMS-K, AMS-T, AMS-St: Acylcyanamide sodium salts corresponding to Formula I based on coconut oil fatty acid, tallow fatty acid and refined, hydrogenated tallow fatty acid. The maximum in the chain length distribution of the alkyl or alkenyl radical R in Formula I is situated at $C_{11}$, $C_{17}$ and $C_{15/17}$, respectively.

ABS: Substantially linear alkylbenzene sulfonate essentially containing 11 to 13 carbon atoms in the alkyl chain TSE: Sulfonate produced from hydrogenated tallow fatty acid methyl ester with $SO_3$ (tallow sulfonate ester)

FAS: Monoalkyl sulfate of hydrogenated fatty alcohol with a maximum in the chain length distribution at $C_{16/18}$ (fatty alcohol sulfate)

SAS: Salt of a sulfonic acid obtained from $C_{12/16}$ paraffins by sulfoxidation (alkane sulfonate)

FAES: Monoalkyl sulfate of the adduct of 3 mols of ethylene oxide with hydrogenated tallow fatty alcohol (fatty alcohol ether sulfate)

SOS: Olefin sulfonate produced from a mixture of substantially linear $C_{15/18}$ olefins by sulfonation with $SO_3$ and hydrolysis TA 5: Adduct of hydrogenated tallow alcohol and 5 mols of ethylene oxide (tallow alcohol—5 E.O.)

TA 10: Adduct of a technical oleyl alcohol (iodine number 45) and 10 mols of ethylene oxide (technical alcohol—10 E.O.)

TA 140: Adduct of hydrogenated tallow alcohol and 14 mols of ethylene oxide (tallow alcohol—14 E.O.)

NP 9.5: Adduct of nonyl phenol and 9.5 mols of ethylene oxide

"SASIL": Sodium aluminium silicate of the zeolite A type having the composition $1.07Na_2O$ $1.00Al_2O_3$ $1.90SiO_2$ $H_2O$ and a calcium binding power of 160 mg of CaO per g of anhydrous substance. The figures in the examples are also based on the anhydrous substance. ["Sasil" is a trademark of Henkel KGaA.]

NTA: Trisodium salt of nitrilotriacetic acid

HEDP: Disodium salt of 1-hydroxyethane-1,1-diphosphonic acid

Silicate: Sodium silicate $Na_2O$ $3.3SiO_2$

Perborate: Technical sodium perborate tetrahydrate containing 10.1% of active oxygen Soap: Mixture of salts of long-chain $C_{16-22}$ fatty acids SiE: Foam inhibitor based on aerosil-bonded polysiloxane CMC: Redeposition inhibitor based on carboxymethyl cellulose and methyl cellulose.

TABLE I

| Ingredient | Content in percent by weight in Examples | | | | | | | | | | |
|---|---|---|---|---|---|---|---|---|---|---|---|
| | 1 | 2 | 3 | 4 | 5 | 6 | 7 | 8 | 9 | 10 | 11 |
| AMS - K | | | | | | | | 6.3 | | | |
| AMS - T | | 6.2 | 5.6 | 5.0 | 2.0 | | | 8.7 | | 8.3 | 16.0 |
| AMS - St | 3.0 | | | | | 8.0 | 4.2 | | 14.0 | 12.0 | |
| ABS | 3.0 | | | 5.0 | | | | | | | |
| TSE | | | | | 2.5 | | 4.0 | | | | |
| FAS | | | | | | | | | | | 10.2 |
| FAES | | | | | | | | 2.0 | | | |
| TA 5 | 1.3 | 1.5 | 1.5 | 2.1 | 2.0 | | | | | | |
| TA 10 | | | | 0.9 | | | | 3.5 | 2.5 | | |
| TA 14 | 2.7 | | 3.0 | 1.5 | 4.2 | | | | | | |
| NP 9.5 | | | | | | 4.6 | | | | | |
| $Na_5P_3O_{10}$ | 40.0 | 28.5 | 18.5 | | | | 19.0 | 30.0 | 29.0 | 12.0 | 25.0 |
| $Na_4P_2O_7$ | | | | | | | | | | 10.5 | 8.4 |
| SASIL | | | 16.0 | 35.0 | 42.0 | 20.0 | 15.8 | | | 21.5 | |
| NTA | | | | | | 3.5 | | | | | |
| HEDP | | | | 1.4 | 2.8 | | | | | | |
| Silicate | 3.0 | 3.0 | 2.5 | 2.5 | 1.5 | | 2.5 | 4.5 | 5.0 | 2.7 | 14.2 |
| $Na_2CO_3$ | | | | | | 10.5 | | | | 12.6 | |
| Perborate | 25.0 | 13.5 | 28.0 | 20.0 | 24.0 | 25.0 | 19.0 | | | | |
| Soap | 3.0 | 2.5 | 1.5 | 3.4 | | 3.2 | 2.2 | 4.5 | 3.3 | | |
| SiE | | | | | 0.1 | | | | | 0.1 | 0.15 |
| CMC | 1.4 | | | 2.4 | | 1.0 | | 1.0 | | | |

TABLE II

| Ingredient | Content in percent by weight in Examples | | | | | | | | | | |
|---|---|---|---|---|---|---|---|---|---|---|---|
| | 12 | 13 | 14 | 15 | 16 | 17 | 18 | 19 | 20 | 21 | 22 |
| AMS - K | 7.0 | | | | 12.0 | 5.5 | 20.0 | | 22.5 | 0.8 | 2.2 |
| AMS - T | 5.5 | | 12.3 | 2.2 | 14.0 | | 25.0 | 4.5 | | | |
| AMS - St | | 13.5 | | | | | | | | | |
| ABS | | | | | 12.5 | | | 24.5 | | | |
| FAS | | | 2.2 | | | | | | | | |
| SAS | | | | | | | | | 4.5 | | |
| SOS | 8.0 | | | | | | | | | | |
| TA 5 | 2.0 | | | | | | | | | | |
| TA 10 | | | | | 12.5 | | | | | 0.7 | |
| TA 14 | | | 1.5 | | | | | | | | |
| NP 9.5 | | 3.2 | | | | 5.5 | | | 18.0 | | |
| $Na_5P_3O_{10}$ | | | | 65.0 | | | | | | | 2.5 |
| SASIL | 14.6 | | 19.2 | | | | | | | | |
| NTA | | | 14.5 | | 4.5 | | 1.7 | | | | |
| HEDP | | | | | | | | | | 0.2 | |
| Silicate | 10.2 | 14.5 | 3.3 | 2.0 | | | | | 7.5 | | |
| $Na_2CO_3$ | 14.3 | 25.0 | 9.4 | | | | 2.5 | | 4.5 | | 3.0 |
| Perborate | | | | | | | | | | | |
| Soap | 2.5 | | 1.5 | | | | 13.0 | | | | |
| SiE | | 0.2 | | | | | | | | | |
| CMC | 1.2 | 0.4 | | 1.0 | | | | | | | |

EXAMPLES 1 to 7

The detergents in these examples are general-purpose fabric detergents which contain bleaches and which are suitable for use over a wide temperature range up to and including boil washing. In addition to the ingredients listed in Table 1, the detergent according to Example 3 contains 6.2% by weight of tetraacetyl ethylene diamine, a bleach activator, and 2.0% by weight of a partially neutralized modified polyacrylic acid (Sokalan CP 5). The detergent according to Example 6 contains as additional builder component, 1.1% by weight of the hexasodium salt of ethylene diamine tetrakis-methylene phosphonic acid. The detergent according to Example 7 contains as nonionic surfactant 2.2% of an adduct of $C_{14/15}$-oxoalcohol and 7 mols of ethylene oxide (Dobanol 45-7) and, as an additional builder, 2.5% by weight of the pentasodium salt of aminotris-methylene phosphonic acid.

EXAMPLES 8 and 9

The detergents in question here are both mild detergents.

EXAMPLES 10 and 11

The detergents in question here are bleach-free heavy duty detergents.

EXAMPLES 12 to 14

These general purpose detergents do not contain any bleach and are suitable for medium to low temperature washing. The detergent according to Example 12 contains 0.8% of sodium citrate as an additional builder.

EXAMPLE 15

A soaking and pre-wash composition

EXAMPLE 16

A fabric pretreatment paste

EXAMPLE 17

A liquid spotting composition, particularly for fabrics. It contains as additional nonionic surfactant, 17.0% by weight of an adduct of 7 mols of ethylene oxide with a mixture of secondary $C_{12/14}$ alcohols and, as a calcium complexing agent, 3.0% by weight of ethylene diamine tetraacetate.

EXAMPLE 18

A cleaning paste for cleaning hard surfaces in the home. The soap used consists of potassium salts of tallow fatty acids.

EXAMPLE 19

A disinfecting cleaner in concentrated form which, in addition to the surfactants, contains 2.6% by weight of sodium citrate and 14.5% by weight of a mixture of chlorinated and non-chlorinated phenols as disinfectant.

EXAMPLE 20

A concentrated industrial cleaner having a corrosion-inhibiting effect.

EXAMPLE 21

An aqueous-alcoholic, substantially salt free preparation for cleaning hard surfaces, particularly glass and ceramics. The solution contains 8.0% by weight of ethanol.

EXAMPLE 22

A bleaching and disinfecting scouring agent containing 1.8% by weight of magnesium monoperphthalate and 88.5% of quartz powder.

Comments Regarding Example Formulations

The formulations of Examples 1 to 22 were all found to be effective detergent compositions, and were all within the scope of this invention. It may be noted that each formula contains at least one anionic surfactant which is an acylcyanamide salt according to Forumla I, as well as at least one builder which is a condensed phosphate or a phosphate substitute. Various optional ingredients including nonionic surfactants are present in some formulatons, such optional ingredients being chosen to afford specific utilities.

Summary of the Inventive Embodiments

The ingredients of the detergent compositions of this invention, described more fully above, may be summarized in the following table:

TABLE III

| | amount present (% by weight of the total composition) | | |
|---|---|---|---|
| ingredient | acceptable | preferred | most preferred |
| (a) Formula I acylcyanamide anionic surfactant | 1–30 | 1–30 | 3–15 |
| (b) condensed phosphate or phosphate substitute builder | balance to 100 | balance to 100 | balance to 100 |
| (c) other (non-acylcyanamide) anionic surfactant | 0–30 | 1–30 | 3–15 |
| (d) nonionic surfactant | 0–30 | 1–30 | 2–15 |
| (e) peroxide bleach | 0–40 | 1–40 | 1–30 |
| (f) foam regulator | 0–20 | up to 20 | 0.1–10 |
| (g) activator | 0 to 1 equivalent | up to 1 equivalent | 0.1–1 |
| (h) stabilizer | 0–5 | up to 5 | .01–5 |
| (i) auxiliary ingredients | (small amounts additional to 100%) | | |
| (j) a + d combination in 1:4 to 4:1, preferably 2:3 to 4:1 ratio | 0–50 | 2–50 | 5–30 |

The above ingredients may be combined in various embodiments, some of which are as follows:

TABLE IV

| Embodiment No. | Ingredients (from Table III) |
|---|---|
| 1 | a, b |
| 2 | a, b, c |
| 3 | a, b, d |
| 4 | a, b, c, d |
| 5 | j, b |
| 6 | a, b, c, d, e, f, g, h |
| 7 | any of the above + i |

We claim:

1. A detergent composition for fabrics consisting essentially of:

(a) at least one acylcyanamide salt anionic surfactant present in about 1–30% by weight, having the formula

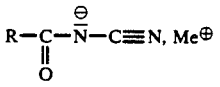

in which Me is sodium or potassium and R is a $C_{9-23}$ alkyl or alkenyl, unsubstituted or substituted by at least one hydroxyl or alkoxyl group;

(b) a builder which is at least one condensed phosphate, or phosphate substitute comprising an inorganic or organic compound having a builder effect at least partly equivalent to that of sodium tripolyphosphate, present in an amount sufficient to balance the composition to 100% by weight;

(c) a non-acylcyanamide anionic surfactant, in an amount of 0 to about 30% by weight, which is alkylbenzene sulfonate, alpha-sulfofatty acid esters, alkane sulfonate, olefin sulfonate, alcohol sulfate, alkyl polyglycol ether sulfate, or any mixture thereof;

(d) a nonionic surfactant, in an amount of 0 to about 30% by weight, which is an alcohol ethoxylate, alkyl phenol ethoxylate, or any mixture thereof;

(e) a peroxide bleach, in an amount of 0 to about 40% by weight;

(f) a foam regulator, in an amount of 0 to about 20% by weight;

(g) a bleach activator, in an amount of 0 to about 1 equivalent, based on the quantity of bleach present;

(h) a bleach stabilizer, in an amount of 0 to about 5% by weight; and (i) at least one auxiliary ingredient which is an enzyme, perfume oil, electrolyte, microbicide, or optical brightener, in an amount of 0 to a small percentage in addition to 100% of the detergent composition as defined by the foregoing ingredients.

2. The detergent composition of claim 1 wherein, in said acylcyanamide, R is an unsubstituted $C_{11-17}$ alkyl or alkenyl and Me is sodium.

3. The detergent composition of claim 1 wherein said nonionic surfactant (d) has the formula $$R-O-(CH_2-CH_2-O)_m-H$$

in which R is a $C_{12-18}$ n-alkyl or n-alkenyl and m has an average value of about from 4 to 15.

4. The detergent composition of claim 1 wherein said builder (b) is sodium triphosphate, sodium aluminum silicate, sodium nitrilotriacetate, sodium alkane polyphosphonate, or any mixture thereof.

5. The detergent composition of claim 1 wherein said non-acylcyanamide anionic surfactant (c) is present in about 1 to 30% by weight.

6. The detergent composition of claim 5 wherein said acylcyanamide anionic surfactant (a) is present in about 3 to 15% by weight and said non-acylcyanamide anionic surfactant (c) is present in about 3 to 15% by weight.

7. The detergent composition of claim 6 wherein: in said acylcyanamide anionic surfactant (a), R is an unsubstituted $C_{11-17}$ alkyl or alkenyl and Me is sodium; and said builder (b) is sodium triphosphate, sodium aluminum silicate, sodium nitrilotriacetate, sodium alkane polyphosphonate, or any mixture thereof.

8. The detergent composition of claim 1 wherein said nonionic surfactant (d) is present in about 1 to 30% by weight.

9. The detergent composition of claim 3 wherein said acylcyanamide anionic surfactant (a) is present in about 3 to 15% by weight and said nonionic surfactant (d) is present in about 2 to 15% by weight.

10. The detergent composition of claim 9 wherein: in said acylcyanamide anionic surfactant (a), R is an unsubstituted $C_{11-17}$ alkyl or alkenyl and Me is sodium; said builder (b) is sodium triphosphate, sodium aluminum silicate, sodium nitrilotriacetate, sodium alkane polyphosphate, or any mixture thereof; and said nonionic detergent (d) is an alcohol ethoxylate, an alkyl phenol ethoxylate, or any mixture thereof.

11. The detergent composition of claim 1 wherein: said non-acylcyanamide anionic surfactant (c) is present in about 1 to 30% by weight; and said nonionic surfactant (d) is present in about 1 to 30% by weight.

12. The detergent composition of claim 11 wherein: said non-acylcyanamide anionic surfactant (a) is present in about 3 to 15% by weight; said non-acylcyanamide anionic surfactant (c) is present in about 3 to 15% by weight; and said nonionic surfactant (d) is present in about 2 to 15% by weight.

13. The detergent composition of claim 12 wherein: in said acylcyanamide anionic surfactant (a), R is an unsubstituted $C_{11-17}$ alkyl or alkenyl and Me is sodium; said builder (b) is sodium triphosphate, sodium aluminum silicate, sodium nitrilotriacetate, sodium alkane polyphosphonate, or any mixture thereof; said non-acylcyanamide anionic surfactant (c) is an alkyl benzene sulfonate, ester sulfonate, alcohol sulfonate, or any mixture thereof; and said nonionic surfactant (d) is an alcohol ethoxylate, an alkyl phenol ethoxylate, or any mixture thereof.

14. The detergent composition of claim 3 wherein: said acylcyanamide salt anionic surfactant (a) and said nonionic surfactant (d) are both present in a combination weight ratio of about 1:4 to about 4:1; and said combination is present in about from 2 to 50% by weight.

15. The detergent composition of claim 14 wherein said weight ratio is about 2:3 to about 4:1; and said combination is present in about from 5 to 30% by weight.

16. The detergent composition of claim 1 wherein:

(a) said acylcyanamide salt anionic surfactant is present in about 1 to 30% by weight;

(b) said builder is present in an amount sufficient to balance the detergent composition to 100% by weight;

(c) said non-acylcyanamide anionic surfactant is present in about 1 to 30% by weight;

(d) said nonionic surfactant is present in about 1 to 30% by weight;

(e) said peroxide bleach is present in about 1 to 40% by weight;

(f) said foam regulator is present in up to 20% by weight;

(g) said bleach activator is present;

(h) said bleach stabilizer is present in up to 5% by weight; and (i) said at least one auxiliary non-detergent ingredient is present.

17. The detergent composition of claim 1 wherein:

(a) said acylcyanamide salt anionic surfactant is present in about 3 to 15% by weight;

(b) said builder is present in an amount sufficient to balance the detergent composition to 100% by weight;
(c) said non-acylcyanamide anionic surfactant is present in about 3 to 15% by weight;
(d) said nonionic surfactant is present in about 2 to 15% by weight;
(e) said peroxide bleach is present in about 1 to 30% by weight;
(f) said foam regulator is present in about 0.1 to 10% by weight;
(g) said bleach activator is present in about 0.1 to 1 equivalent;
(h) said bleach stabilizer is present in about 0.01 to 5% by weight; and
(i) said at least one auxiliary non-detergent ingredient is present.

18. The detergent composition of claim 13 wherein:
(a) said acylcyanamide salt anionic surfactant is present in about 1 to 30% by weight;
(b) said builder is present in an amount sufficient to balance the detergent composition to 100% by weight;
(c) said non-acylcyanamide anionic surfactant is present in about 1 to 30% by weight;
(d) said nonionic surfactant is present in about 1 to 30% by weight;
(e) said peroxide bleach is present in about 1 to 40% by weight;
(f) said foam regulator is present in up to 20% by weight;
(g) said bleach activator is present;
(h) said bleach stabilizer is present in up to 5% by weight; and
(i) said at least one auxiliary non-detergent ingredient is present.

19. The detergent composition of claim 13 wherein:
(a) said acylcyanamide salt anionic surfactant is present in about 3 to 15% by weight;
(b) said builder is present in an amount sufficient to balance the detergent composition to 100% by weight;
(c) said non-acylcyanamide anionic surfactant is present in about 3 to 15% by weight;
(d) said nonionic surfactant is present in about 2 to 15% by weight;
(e) said peroxide bleach is present in about 1 to 30% by weight;
(f) said foam regulator is present in about 0.1 to 10% by weight;
(g) said bleach activator is present in about 0.1 to 1 equivalent;
(h) said bleach stabilizer is present in about 0.01 to 5% by weight; and
(i) said at least one auxiliary non-detergent ingredient is present.

* * * * *